US011459151B2

(12) United States Patent
Powell

(10) Patent No.: US 11,459,151 B2
(45) Date of Patent: Oct. 4, 2022

(54) DISPENSING DEVICES AND SYSTEMS

(71) Applicant: Arbor Grace Inc., Detroit, MI (US)

(72) Inventor: Patrick Powell, Detroit, MI (US)

(73) Assignee: Arbor Grace Inc., Detroit, MI (US)

( * ) Notice: Subject to any disclaimer, the term of this patent is extended or adjusted under 35 U.S.C. 154(b) by 316 days.

(21) Appl. No.: 16/828,201

(22) Filed: Mar. 24, 2020

(65) Prior Publication Data

US 2020/0307877 A1 Oct. 1, 2020

Related U.S. Application Data

(60) Provisional application No. 62/823,346, filed on Mar. 25, 2019.

(51) Int. Cl.
*B65D 51/28* (2006.01)

(52) U.S. Cl.
CPC ..... *B65D 51/2807* (2013.01)

(58) Field of Classification Search
CPC ..... B65D 51/2807
USPC ..... 141/112
See application file for complete search history.

(56) References Cited

U.S. PATENT DOCUMENTS

| | | | | |
|---|---|---|---|---|
| 3,321,097 | A | 5/1967 | Solowey | |
| 4,247,001 | A | 1/1981 | Wiegner | |
| 5,310,564 | A | 5/1994 | Kimm | |
| 6,561,232 | B1 | 5/2003 | Frutin | |
| 6,609,612 | B2 | 8/2003 | Vlodek | |
| 6,926,138 | B1 | 8/2005 | Basham | |
| 6,959,841 | B2 | 11/2005 | Vlodek | |
| 7,537,112 | B2 | 5/2009 | Balazik | |
| 7,874,420 | B2 | 1/2011 | Coon | |
| 9,061,794 | B2 | 6/2015 | Karabinis | |
| 9,272,827 | B2 * | 3/2016 | Marina | A23L 2/52 |
| 9,771,194 | B1 | 9/2017 | Lefkovitz | |
| 10,315,815 | B2 * | 6/2019 | Bentkovski | B65D 47/0857 |
| 10,913,647 | B2 * | 2/2021 | Lyons | B67D 1/0079 |
| 2008/0023349 | A1 | 1/2008 | Balazik | |
| 2008/0290059 | A1 | 11/2008 | Benbassat | |
| 2009/0206084 | A1 | 8/2009 | Woolf et al. | |
| 2012/0012008 | A1 * | 1/2012 | Kwok | A47J 31/0615 99/299 |
| 2012/0024812 | A1 | 2/2012 | Underwood | |
| 2016/0031598 | A1 | 2/2016 | Rose | |

(Continued)

FOREIGN PATENT DOCUMENTS

| | | | | |
|---|---|---|---|---|
| KR | 1348415 B1 * | 1/2014 | | B65D 51/2807 |
| WO | WO-2018194450 A1 * | 10/2018 | | A47G 19/16 |

*Primary Examiner* — Timothy L Maust
(74) *Attorney, Agent, or Firm* — Panagos Kennedy PLLC; Bill Panagos; Linda Kennedy

(57) ABSTRACT

Dispensing devices and systems for dispensing materials into a host vessel, optionally containing a host substance, are provided. The dispensing devices are removably attachable, in whole or in part, to a host vessel such as a water bottle or an alcohol bottle. The dispensing devices generally include a rotating capsule (perhaps with a quantity of flavor or nutritional supplements in the capsule) that can be rotated to a position to dispense the contents of the capsule into the host vessel. Depending upon configuration, the act of dispensing may involve squeezing, shaking, or the simple passive step of permitting gravity to act on the contents of the capsule.

15 Claims, 8 Drawing Sheets

(56) References Cited

U.S. PATENT DOCUMENTS

2016/0264323 A1* 9/2016 Jeon ..... B65D 51/243
2020/0039738 A1* 2/2020 Duman ..... A47G 19/22

* cited by examiner

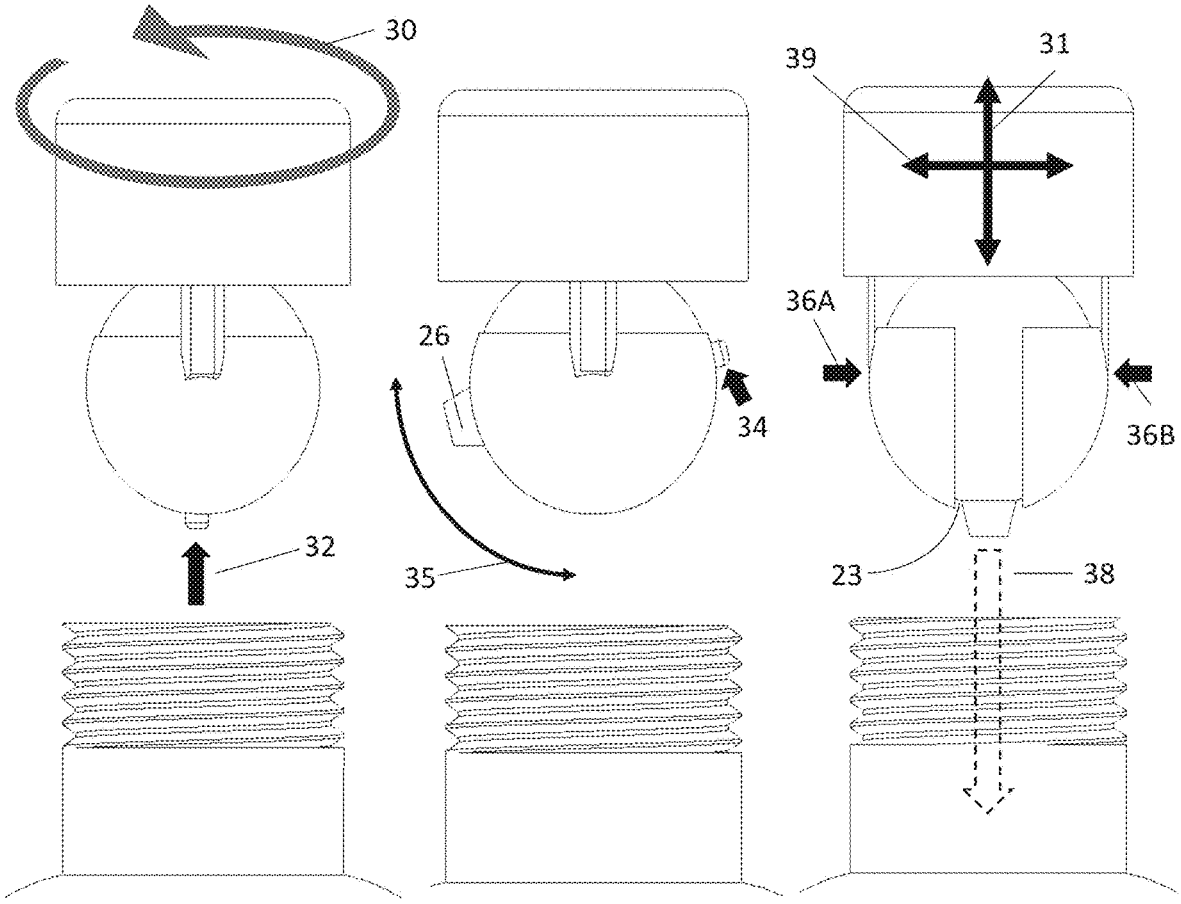
FIGURE 3A
FIGURE 3B
FIGURE 3C
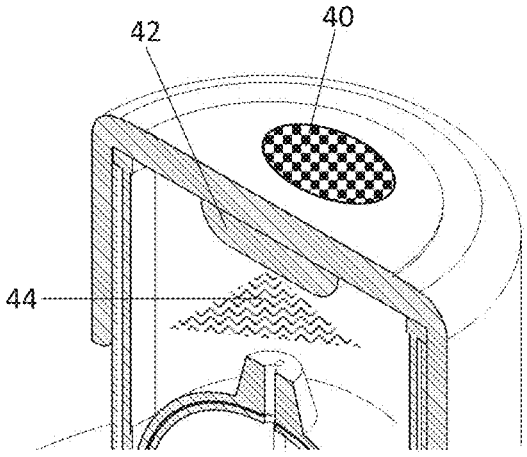
FIGURE 4
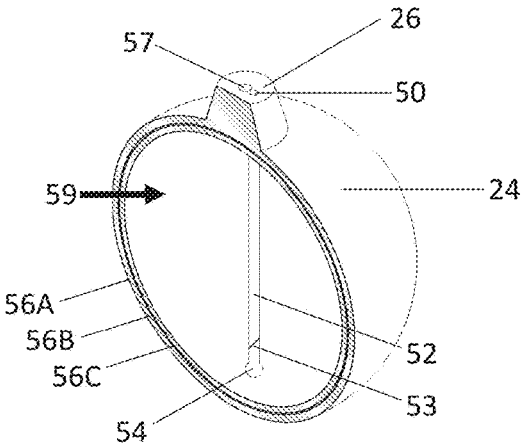
FIGURE 5

DISPENSING DEVICES AND SYSTEMS

RELATED APPLICATIONS

This disclosure claims the benefit of the priority date of U.S. provisional patent application No. 62/823,346, filed Mar. 25, 2019, incorporated herein in its entirety.

TECHNICAL FIELD

This disclosure relates to devices and systems for dispensing one or more materials (such as flavor or nutritional additives) into a host vessel (such as a plastic, glass or metal bottle), which may contain a host substance (such as a beverage).

BACKGROUND

Like in many industries, there is an increasing demand for personalization in the food and beverage world. Many products in this industry are mass produced, such as bottled beverages. Personalization is often performed manually by individuals themselves or by servers in diners, restaurants and bars.

There is a need for devices that permit individuals and servers to add specific amounts of the personal additives of choice to host substances of choice. It could be two lumps of sugar with tea, or a shot of lemon-flavored vodka to a plastic bottle containing sparkling water. For others, the additive and host substance of choice may be a protein powder dispensed into a bowl of chili.

Devices and systems permitting such personalization have application beyond the food beverage industry. Many consumer products, for example, could be individualized with a particular scent or color.

There also exists a need for manufacturers, distributors and retailers to reinforce their brand identity through affiliation with new and desirable devices and systems, regardless of industry.

BRIEF DESCRIPTION OF THE DRAWINGS

FIGS. 3A, 3B and 3C show an exemplary method of using a dispensing system.

FIG. 4 is a sectional view an exemplary cover.

FIG. 5 is a sectional view of an exemplary capsule.

DETAILED DESCRIPTION

All figures and examples herein are intended to be non-limiting; they are mere exemplary iterations and/or illustrative embodiments of the claims appended to the end of this description. Modifications to specifically-described devices, systems, the order of steps in processes, etc., are contemplated. The dispensing devices, systems and methods are capable of other embodiments and of being practiced and carried out in various ways. Also, it is to be understood that the phraseology and terminology employed herein are for the purpose of the description and should not be regarded as limiting. Moreover, discussion of the related art throughout the specification should in no way be considered as an admission that such related art is widely known or forms part of common general knowledge in the field.

Figure 1:
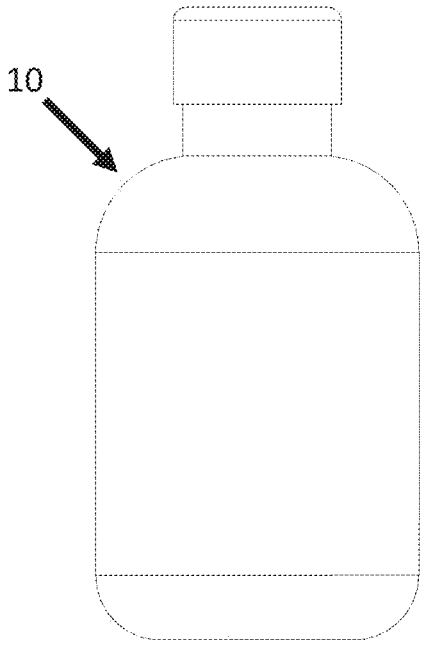
FIG. 1 is an exemplary dispensing system.

Referring to FIG. 1, dispensing system 10 is shown. As illustrated, dispensing system 10 is in a pre-usage or closed position, where the dispensing system 10 can be stored, shipped, and the like. Generally, as used throughout this specification, a dispensing system is a combination of a dispensing device and a host vessel. Exemplary dispensing devices are described in greater detail later in the specification. Although illustrated as attached with a host vessel, dispensing devices need not be attached to a host vessel during storage or shipping.

Host vessels for use in disclosed dispensing systems are contemplated in nearly any material, size and shape. Host vessels may include plastic, glass and metal bottles, jars and jugs. Host vessels may include food containers such as bowls. In some cases, host vessels may include personal-use water or soda bottles having standard mouth size and neck finish, including the standard twisted spiral threading. Contemplated neck finishes include but are not limited to GPI & SPI 400, 410, 415, 425, 430, 2030 and 2035. Closure sizes may include but are not limited to (in mm) 18, 20, 22, 24, 28, and 33. Sizes may be smaller, including as small as 8 mm, and may be larger, including as large as 120 mm. Other type of openings to host vessels are contemplated; host vessels need not have a threaded neck and indeed need not be shaped to have a neck and shoulder. Where the host vessel is plastic, it may be made from any of a number of materials, including food-grade polyolefins such as high-density polyethylene (HDPE), low-density polyethylene (LDPE), polyethylene terephthalate (PET), polycarbonate (PC), polypropylene (PP), and bioplastics. Where the host vessel is metal, it may comprise tin, aluminum, stainless steel or combinations thereof. Host vessels may include labels, paints, colorants, and may be translucent or opaque.

Host vessels may include a host substance. A host substance may be a consumable liquid, solid or gel. Host substances may be hot, warm, room temperature or cool. Exemplary host substances include still and sparkling water, soda, cocoa, tea, coffee, alcohol, juice, smoothies, soups, and solid foods of all kinds: steaks, seafood, vegetarian dishes and the like. A host substance need not be a consumable. Many other packaged liquids, solids and gels may receive an additive by use of the described dispensing devices. Certain host substances may not be packaged in a host vessel but may receive additives via dispensing devices disclosed herein.

Figure 2:
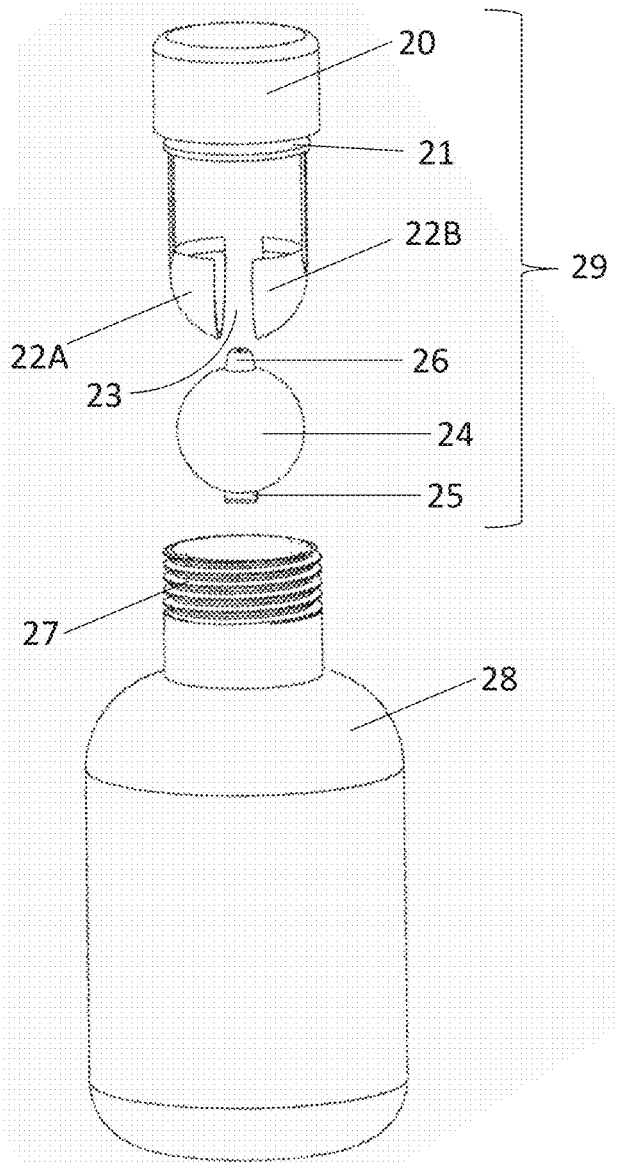
FIG. 2 is an exploded view of an exemplary dispensing system.

With respect to FIG. 2, an exploded view of an exemplary dispensing device 29 is shown. Dispensing device 29 includes rotatable capsule 24 supported by body 21 which is connected with cover 20. Cover 20 may rotated in one direction to be released from the threading 27 on a neck of host vessel 28. Capsule 24 may be rotated in a direction generally orthogonal to the direction of rotation of the cover 20. Rotation of capsule 24 may be guided by moving tab 25 through pathway 23 to re-position dispensing portal 26 from a closed position facing toward cover 20 away and from host vessel 28 to an open position that is different from the closed position. The open position may cause the dispensing portal 26 to face toward host vessel 28 or toward an un-vesseled host substance. Body 21 has portions 22A and 22B that can be squeezed by hand (for example between a thumb and index finger), to apply force on capsule 24 and dispense contents from capsule 24 into host vessel 28. In some embodiments, the force for dispensing may be less than 200 newtons, 100 newtons, or 50 newtons.

In FIG. 2, capsule 24 is shaped as a sphere or spheroid, but other shapes that could be rotated in body 21 (which can have a variety of shapes) are contemplated, such as cylinders or conical sections. Capsule 24 is hollow as manufactured, but is configured to be filled, at least partially, with contents for dispensing. Exemplary contents of capsule 24 may be liquid or solid, and may in many forms, including solutions, suspensions, gels, powders and other forms such as porous bags (tea bags, for example). Such materials may include flavorings, sugars, artificial sweeteners, dairy products, coffees, teas, fruit juices, vegetable juices, powders, carbonated fluids, colorants, pharmaceuticals, alcohols, cleaning agents, cosmetics, perfumes, paints, varnishes, air modifiers, and cough syrups. A wide variety of hemp products in a dispensable form, such products containing not more than 0.3 percent THC (tetrahydrocannabinol) are contemplated. Contents may be or include toys, trinkets or prizes or other token item that a manufacturer wishes to distribute. It is contemplated that contents of capsule 24 may be at a higher pressure than the surrounding environment, which may facilitate dispensing and which may have an impact upon storage and shipping conditions.

In one embodiment, capsule 24 may be made from materials that are sufficiently flexible to be squeezed by human fingers directly (or indirectly if squeezing is performed on a cover of a certain dimension, or the body which in turn act on the capsule 24). Such materials include but are not limited to food grade materials, including plastics, rubber, silicones and combinations thereof. By way of non-limiting example, linear low-density polyethylene (LLDPE), LDPE, ethylene propylene diene monomer rubber (EDPM), polyethylene, polypropylene, neoprene, and silicone rubbers may be suitable. An anti-permeation material is also contemplated for use with capsule 24. Such materials can be a coating, part of a multi-layer structure, blended within a polymer of a primary material (PET, e.g.), or an added oxygen scavenger. A non-limiting example of an anti-permeation materials include ethylene-vinyl alcohol copolymer (EVOH), poly(acrylo nitril) (PAN), poly(butylene terephthalate) (PBT), polyvinylidene fluoride (or difluoride) (PVDF), and oriented polyamide (ONY).

In other embodiments, capsule 24 is not sufficiently flexible for squeezing, and body 21 need not have sections that are sufficiently flexible for squeezing. In such embodiments, capsule 24 may be made of, for example, glass, metal or wood. Capsule 24 may also include anti-microbials to mitigate risk of transfer of micro-organisms like bacteria, viruses or pathogens. Capsule 24 may also have an additional wrap around it for storage and shipping to protect against damage or leakage. Dispensing contents in such capsules 24 requires gravity and or applied forces such as shaking. Capsule 24 may have markings or another metering system to permit users to select specific quantities or dosages of contents.

As illustrated, capsule 24 has tab 25 protruding from its surface as well as dispensing portal 26 protruding from its surface. Tab 25 is only one of several contemplated mechanisms for rotation assistance. Other contemplated structures include but are not limited to texturing on the surface of capsule 24, markings on the capsule 24 or body 21 or cap 20 to indicate a direction of rotation, etc. Dispensing portal 26 need not protrude from the surface; an aperture in the surface of capsule 24 would also provide structure sufficient for dispensing contents of capsule 24. Dispensing portal 26 may optionally include a liquid-tight seal on its surface, removable by hand before dispensing of contents. When dispensing portal 26 is configured as a protrusion, the protrusion may comprise the same or a different material from capsule 24. When configured as a one-way dispenser, for example, an elastomeric material may be suited. When configured for a turn-open-pour operation, more rigid plastics may be suitable. In an event, whether or not configured as a protrusion, the aperture in dispensing portal 26 may be sized and shaped depending upon contents of capsule 24.

Body 21 and cover 20 may be integrally formed or may be removably attachable from one another. Body 21 and cover 20 may be of nearly any material and sized and shaped to be compatible with host vessel 28. Plastics are contemplated, including polyolefins such as PE, PET, HDPE, LDPE, PP, PS and others. At least one of body 21 and cover 20 may be mechanically connectable to host vessel 28. As illustrated, cover 20 engages threading 27 on the neck of host vessel 28. Other contemplated structures involve one of the body or cover being insertable into a neck of host vessel 28 with a spring force or friction fit holding it in place, or a snap fit over a neck of host vessel 28. The cover 20 may include a first soft seal for sealing to host vessel 28, and such seal may optionally engage body 21, capsule 24 and cover 20 to act as a three-way seal during storage and shipping.

Referring to FIGS. 3A, 3B and 3C, an exemplary method of using a dispensing system is shown. In FIG. 3A, a cover is rotated along a spiral path in a direction to separate the dispensing device from the host vessel, indicted with motion 30. A motion in the opposite direction would re-connect the dispensing device with the host vessel. When separated, the dispensing device may be lifted from the host vessel, indicated with motion 32. Then, in FIG. 3B, the capsule may be rotated in a direction generally orthogonal to the separation direction to move the dispensing device from a closed position to an open position (and back again). FIG. 3C shows a view that is 90 degrees from the views of FIGS. 3A and 3B, and it shows the pathway 23 through which the tab 34 and the dispensing portal 26 move to rotate the capsule. In embodiments where the capsule can be squeezed, motions 36A and 36B indicate the finger or hand-squeezing direction to dispense contents. In embodiments where the capsule is of a material that it cannot be squeezed, then the dispensing device can be shaken side to side (motion 39), up and down (motion 31) or other directions or combinations of directions. Whether by squeezing, applied force, or passive gravity, contents move from the capsule generally as indicated by motion 38.

Referring to FIG. 4, an exemplary cover is illustrated for use with disclosed dispensing devices. The cover supports an energy conversion device 40 and an illumination source 42 attached thereto. The illumination source, when powered, emits light as indicated by light waves 44. The lighting effects can highlight a name or logo or other brand identity indicator such as color, and/or the lighting can create a novelty shadow effect. In some embodiments, the lighting effect bears a relationship to the host substance to which the substance will be added. For example, it may illuminate water to appear orange if the contents of the capsule are Vitamin C or orange flavoring. Exemplary energy conversion devices include photovoltaic cells for converting visible, infrared and ultraviolet light into electricity. Such original light source may include the sun or a light from within a refrigerator. Exemplary illumination sources in electrical communication with the energy conversion devices may include a light-emitting diode (LED), such as but not limited to light and flexible printed LEDs such as micro LEDs. In some embodiments, host vessels for use with such covers may be transparent or have a color that is translucent. The illumination source may be in electrical and/or mechanical communication with an on/off switch.

Referring to FIG. 5, an exemplary capsule 24 is shown. In this embodiment, it is contemplated that capsule 24 may be squeezed (motion 59) directly or indirectly and may re-inflate after squeezing through a snorkel assembly 52. For dispensing, dispensing portal 26 includes aperture 57 for dispensing contents through a channel aligning an aperture in dispensing capsule 24 with aperture 57. For re-inflating, dispensing portal 26 is sized and shaped to include a portion of snorkel assembly 52. Snorkel assembly 52 has a channel extending from on one end with an air intake 50 on the dispensing portal 26 and an exhaust end 54 in the capsule 24. Snorkel assembly 52 may optionally include a one-way valve such as a check valve at or near the exhaust end 54. The example of FIG. 5 shows capsule 24 as a multi-layer structure. As illustrated, anti-permeation layer 56B is sandwiched between inner layer 56C and outer layer 56A. Two-layer, single layer and other configurations are also contemplated, including those that may mitigate risk of hydrocarbon permeation in or out of capsule 24, which may in turn mitigate risk of spoilage and/or pre-mature combining of the contents of capsule 24 with a host substance.

Figure 6:
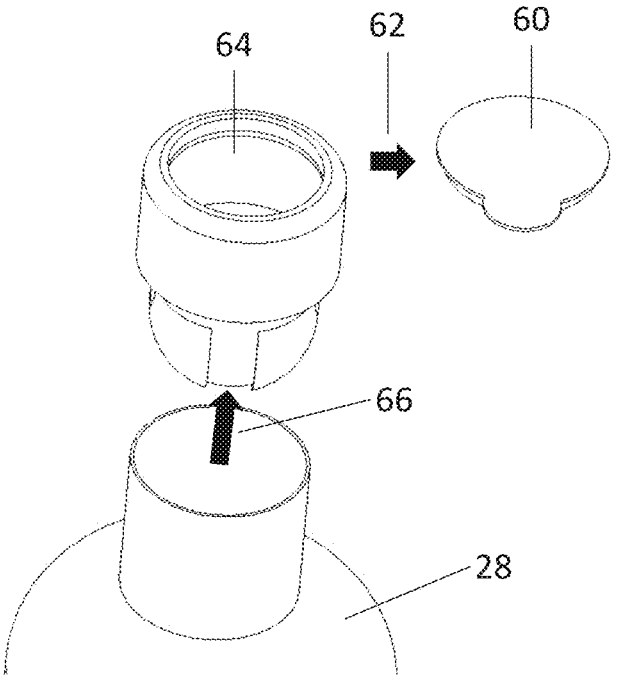
FIG. 6 is an exploded view of an exemplary dispensing system.

Referring to FIG. 6, an exploded view of an exemplary dispensing system is shown. The cover includes a removable top portion 60. Top portion 60 may include any of a number of paper, plastic or foil seals, for example, a liquid tight seal and/or an air and watertight hermetic seal. Contemplated seals include heat induction foil seals, PE seals, pressure sensitive liners of PS or polycone, for example. When top portion 60 is removed, through motion 62, topless cover 64 is created. Topless cover 64 and body and capsule can be removed from host vessel 28 through motion 66, possibly following un-fastening a mechanical connection such as a friction fit. The entirety of the topless cover 64 and body and capsule can be inverted to permit dispensing of contents through the capsule and the topless cover 64, either immediately (if the dispensing portal is stowed in an open position) or following rotating the capsule to move the dispensing portal to an open position.

Figure 7:
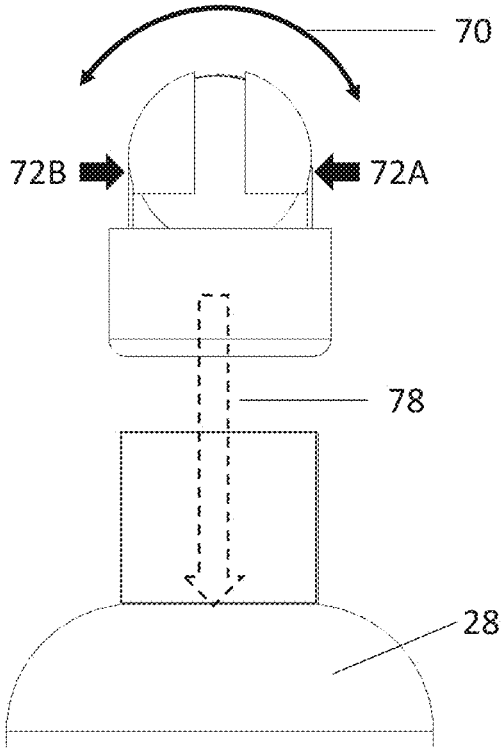
FIG. 7 shows a use of an exemplary dispensing system.

Referring to FIG. 7, an invertible dispensing system like the one in FIG. 6 is shown. Here, a topless cover has been inverted and placed above a host vessel 28. Optionally, the topless cover can be re-secured to host vessel 28 in the inverted position. As illustrated, the capsule is rotatable with or without a rotation assistance mechanism (not shown) using motion 70 to move the dispensing portal (not shown) into an open position for dispensing contents when the body is squeezed as shown in the squeeze motions 72A and 72B. The contents then flow along flow arrow 78 into host vessel 28. Although flow arrow is shown 180 degrees from a starting closed position, flow does not require such precision. It is contemplated that flow will begin before a 180 degrees is reached and may continue beyond 180 degrees when rotated by hand.

Figure 8:
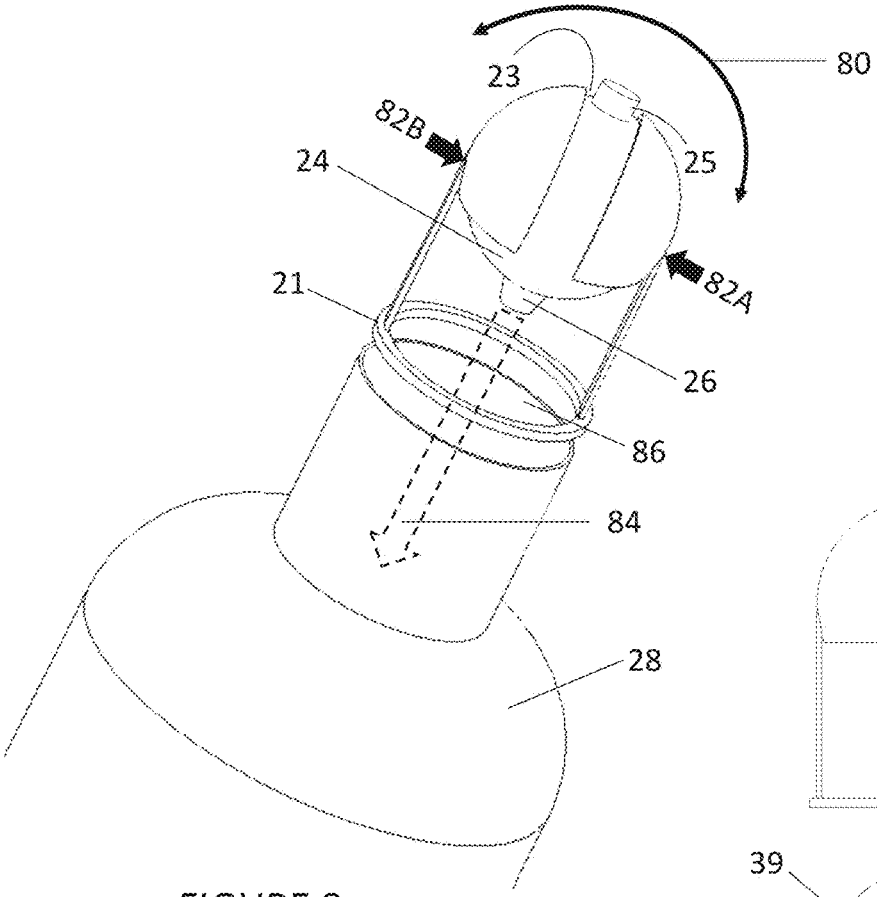
FIG. 8 shows a use of an exemplary dispensing system.

Referring to FIG. 8, an invertible dispensing system similar to the one in FIG. 7 is shown, but without the topless cover. A cover has been removed, and body 21 has been inverted, rotatably supporting capsule 24. Optionally, the body 21 can be reconnected with the host vessel 28. The tab 25 is movable through pathway 23 to rotate the capsule 24 to place the dispensing portal 26 in an open position. When the body 21 and the capsule 24 are squeezed, contents are dispersed through the dispensing portal 26 and the aperture 86 in the body as shown in flow arrow 84.

Figure 9:
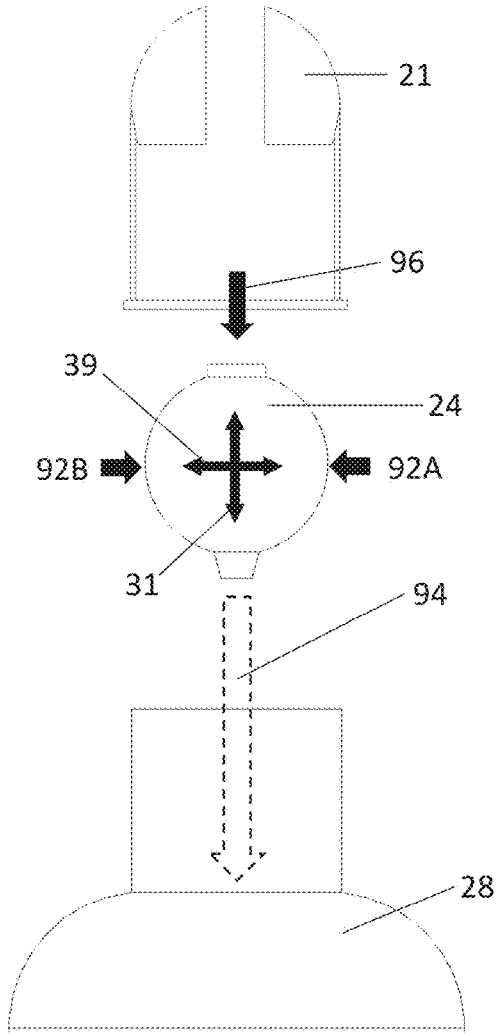
FIG. 9 is an exploded view of an exemplary dispensing system.

Referring to FIG. 9, an invertible dispensing system like the one in FIG. 8 is shown, but the capsule is removable from the body and the cover. This embodiment may be adapted for use where there is no host vessel and the dispensing device is used directly with a host substance. For example, this dispensing device may be suited for adding a spice to a pizza. As illustrated, the body 21 is removed from the host vessel 28, and the capsule 24 is removed from the body 21 to force the capsule 24 outside of the body 21 (motion 96). The capsule can be shaken up and down and laterally (motions 31 and 39) or in other directions to dispense contents along flow arrow 94 into host vessel 28. Alternatively, the capsule can be squeezed (motions 92A and 92B) or in other directions to dispense contents along flow arrow 94 into host vessel 28.

Figure 10:
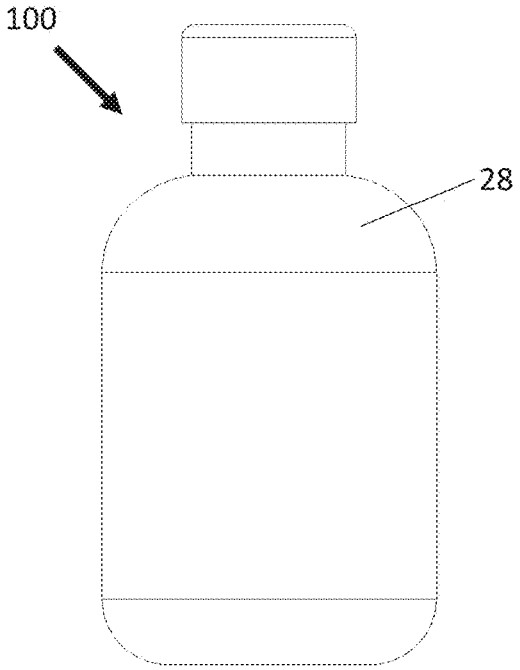
FIG. 10 is an exemplary dispensing system.
Figure 11:
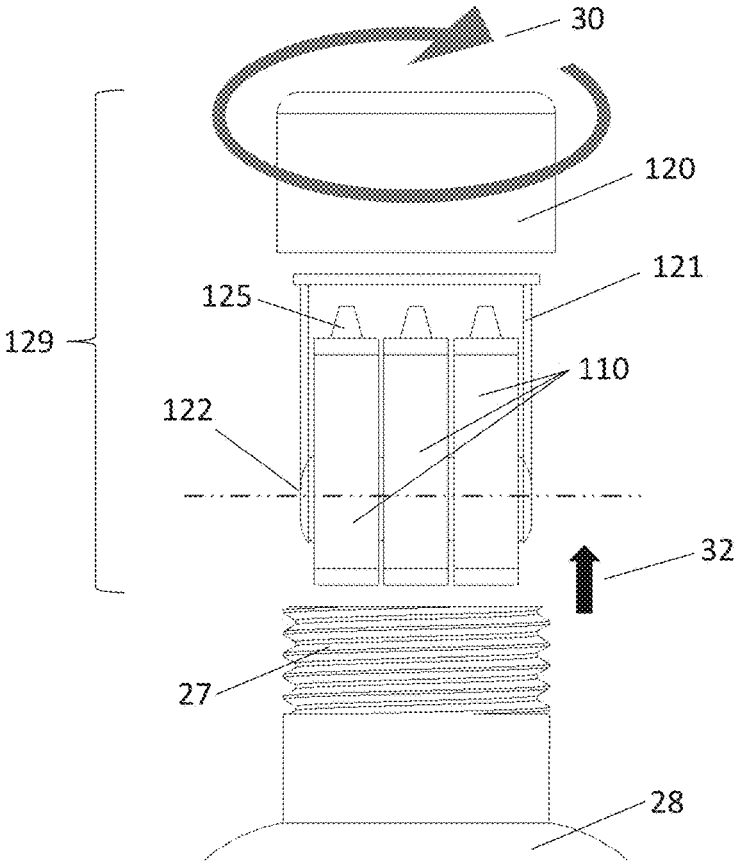
FIG. 11 is an exploded view of an exemplary dispensing system.

Referring to FIG. 10, an alternative dispensing system 100 is illustrated where the dispensing device is mechanically connected with the host vessel 28. Referring to FIG. 11, an exploded view of dispensing device 129 is illustrated. Dispensing device includes a cover 120 connected with a body 121 securing a plurality of capsules 110 that are rotatable about axle 122, which is connected with the body 121. The cover 120 can be twisted (motion 30) in a direction to connect or in the opposite direction to disconnect from threading 27 in host vessel 28. When disconnected, a pull motion 32 can remove the some or all of the dispensing device from the host vessel 28. The capsules 110 have dispensing portals 125, which can be stored or shipped in the illustrated closed position. Capsules 110 can be rotated independently or as a unit. The capsules 110 are rotatable between open and closed positions, the direction of rotation being orthogonal to the direction of twisting the cover 120 for connection and disconnection to the host vessel. For shipping and storage purposes, capsules 110 may optionally be secured together in a shrink-wrap package or with elastomeric bands or other mechanical binding devices. Such devices can assist with recycling and re-usability purposes by preventing a larger plastic element from becoming a series of smaller plastic elements.

Figure 12:
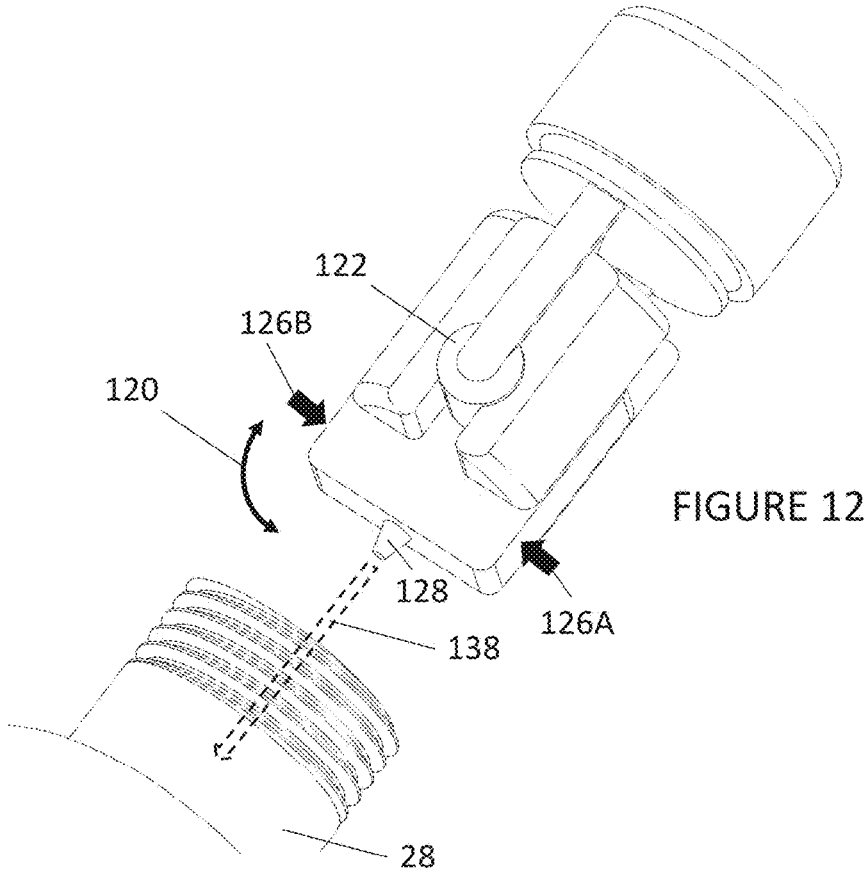
FIG. 12 is an exploded view of an exemplary dispensing system.

Referring to FIG. 12, an embodiment similar to FIG. 11 is disclosed. FIG. 12 shows a single capsule 124 rotating (motion 120) about axle 122 so that its dispensing portal 128 is in an open position to dispense contents of the capsule 124 along flow line 138 into host vessel 28. As drawn, the act of dispensing may be actuated by squeezing the capsule 124 in a portion of the capsule 124 that extends beyond the body. Squeezing along motion lines 126A and 126B would cause contents of capsule 124 to dispense. Other actuation models are contemplated where the material of capsule 124 is not sufficiently flexible for hand or finger squeezing.

Figure 13:
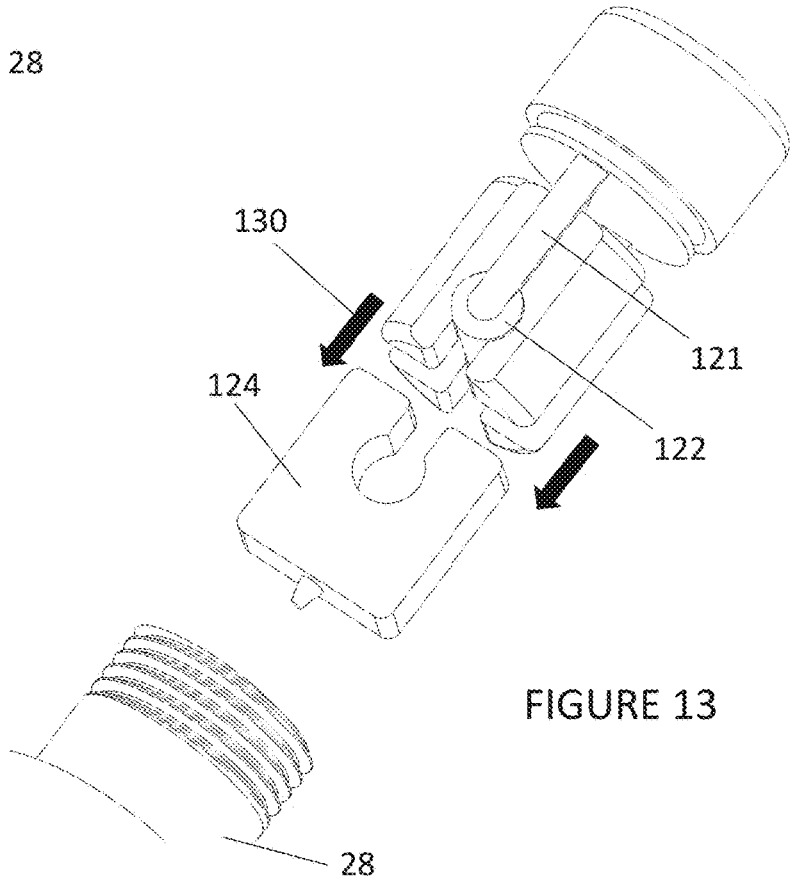
FIG. 13 is an exploded view of an exemplary dispensing system.

Referring to FIG. 13, an embodiment similar to FIG. 12 is disclosed. Here, capsule 124 is separable from the body 121 and from the axle 122 when force is applied (motion 130) to disengage the capsule 124. When disengaged, one can actuate dispersing of the contents of capsule 124 by squeezing, shaking, or permitting gravity to act on the contents.

Figure 14:
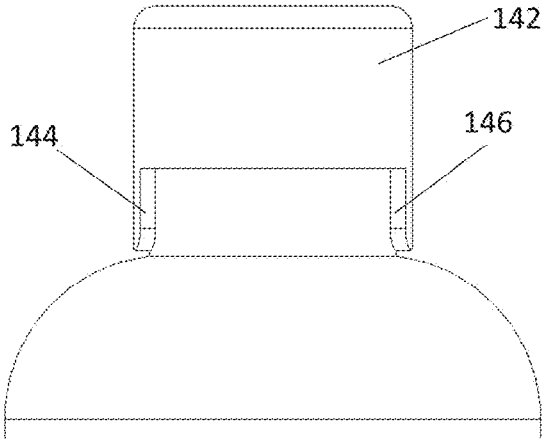
FIG. 14 is a front view of an exemplary cover.
Figure 15:
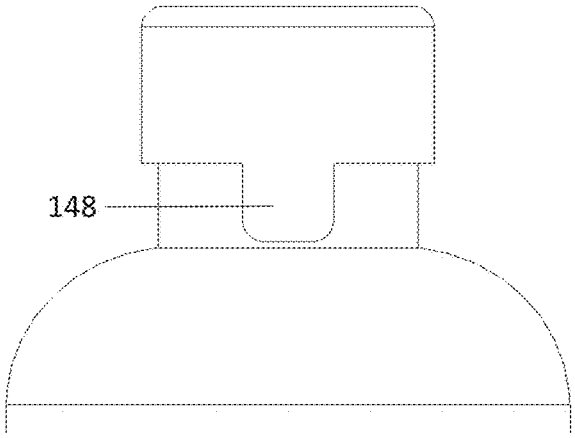
FIG. 15 is a side view of an exemplary cover.

Referring to FIGS. 14 and 15, different views of cover 142 are shown. Cover 142 may have a plurality of tabs extending from the cover 142. FIG. 14 shows tabs 144 and 146, and FIG. 15 shows tab 148 extending from the cover 142. Various versions of these covers may be used with other body and capsule systems. Tabs may be hand or finger squeezed to act on the body and or the capsule to disperse contents of the capsule. It is contemplated that some embodiments do not include extensions, but the cover may nevertheless be squeezed to act on the body and or the capsule to disperse contents of the capsule.

Figure 16:
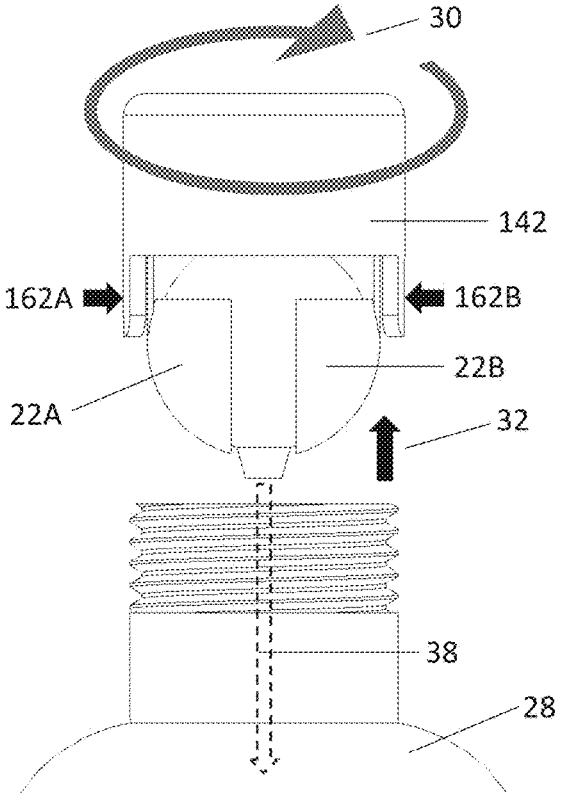
FIG. 16 is an exploded view of an exemplary dispensing system.

Referring to FIG. 16, an exploded view of an exemplary dispensing system is shown. Here, cover 142 can be rotated in a direction to connect (motion 30) or the opposite direction to disconnect from host vessel 28. A lifting motion (motion 32) removes the dispensing device from the host vessel 28. The capsule may be rotated to place the dispensing portal in the open position. Tabs may be squeezed (motions 162A and 162B) to apply force to the body portions 22A and 22B, respectively. The squeezing force causes the contents to disperse along flow line 38.

Figure 17:
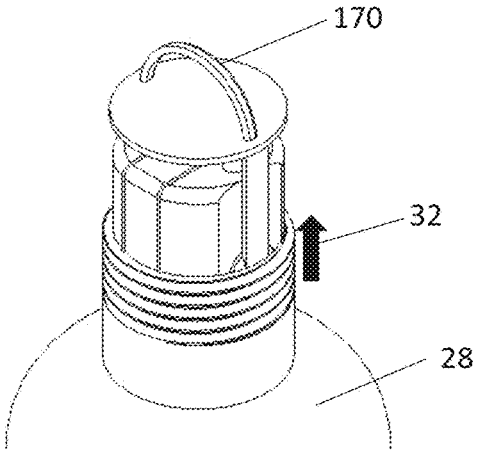
FIG. 17 is an exemplary dispensing system.

Referring to FIG. 17, an alternative configuration of a cover is disclosed for use with embodiments such as the dispensing device described in FIG. 11. The cover includes an assertion-and-removal assistance mechanism 170. As shown, the mechanism is a tab in the form of an arch. Many other mechanisms may be suitable, such as cover shaped to include a push-pin type groove about the perimeter fitted for fingers, tabs of other shapes and sizes and locations, tabs that are foldable to rest upon a top portion of the cover, etc. Motion 32 indicates how the mechanism 170 may assist with removal of the dispensing device from the host vessel 28.

Figure 18:
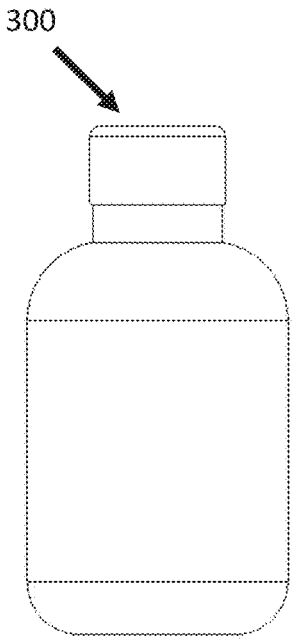
FIG. 18 is an exemplary dispensing system.
Figure 19:
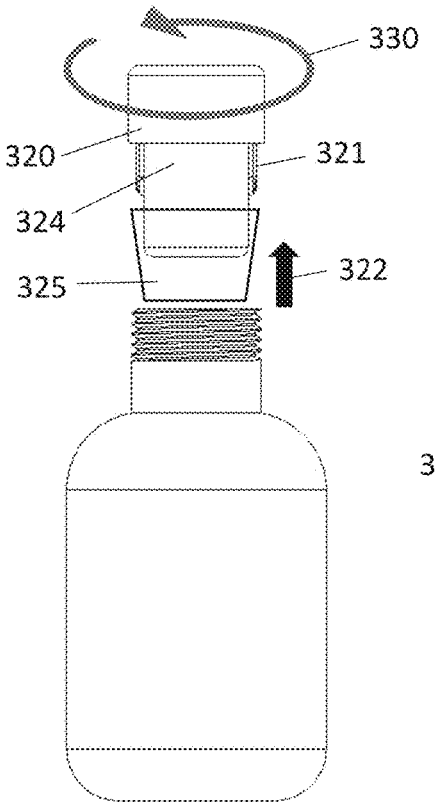
FIG. 19 is an exemplary dispensing system.
Figure 20:
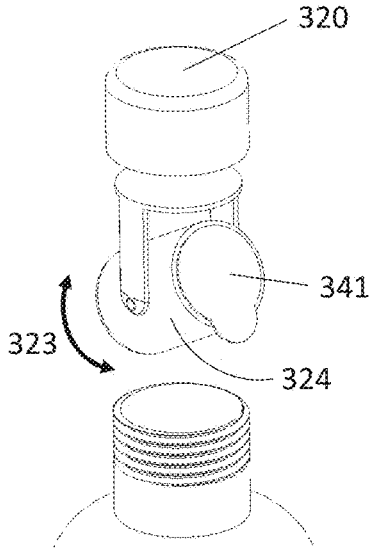
FIG. 20 shows a use of an exemplary dispensing system.

Referring to FIG. 18, an alternative dispensing system 300 is illustrated. Referring to FIG. 19, capsule 324 is rotatably secured to body 321, which is connected to cover 320. In some embodiments, the body 321 and the cover 320 are removably connected to one another. In some embodiments, capsule 324 is rotatably supported by cover 320, including any tabs that may extend therefrom. To use the dispensing system 300, a user may twist the cover 320 to an open position (motion 330) and lift the dispensing device using motion 322. Then, in some embodiments, the user may remove or discard a secondary barrier 325 between the dispenser device 300 and the host vessel. In some embodiments, the secondary barrier is on or over the capsule 324. In other embodiments, the secondary barrier is on or over the host vessel. Then, with reference to FIG. 20, the user may rotate capsule 324 to an open position using motion 323. Then, the user may remove the seal 341 and dispense the contents of capsule 324.

Figure 21:
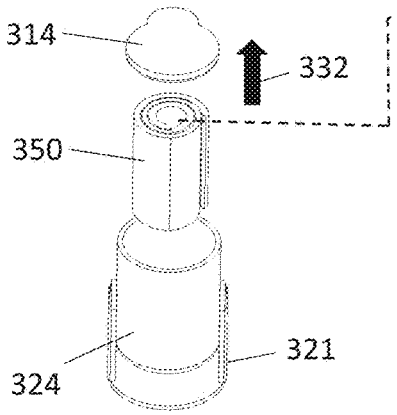
FIG. 21 is an exploded view of an exemplary dispensing system.

Referring to FIG. 21, an exemplary dispensing system is illustrated. No cover is shown, but a cover may be used with capsule 324 and body 321. Here, capsule 324 includes contents showing a rolled bag 350, which may be removed from capsule 24 using motion 332 after seal 341 is removed. Upon removal, the bag 350 (perhaps of tea leaves) may be immersed, for example, in a hot host substance in host vessel 28.

Figure 22:
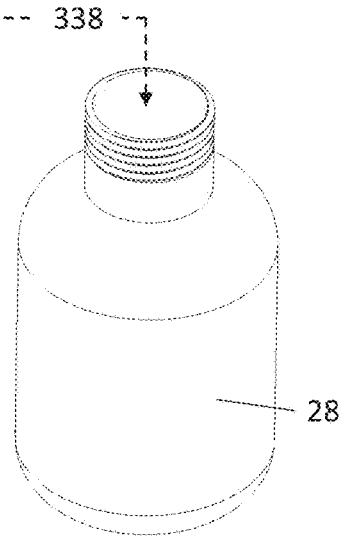
FIG. 22 is an exemplary capsule.
Figure 22:
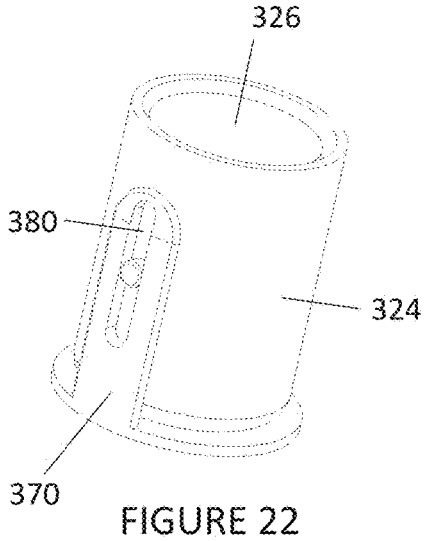

Referring to FIG. 22, an exemplary capsule 324 is shown. Capsule 324 is rotatably supported in body 370 with a telescoping feature 380 allowing the capsule 324 to rest against the body 370, for example, to prevent capsule 324 from dispensing contents 326 until operably manipulated by a user. Mechanical attachments are contemplated, including snaps, rotation lugs and like devices that have complementary receiving structure on capsule 324. A friction fit of capsule 324 in body 370 is also contemplated. Here, capsule 324 includes contents 326 illustrated as either a consumable liquid, like alcohol or cough syrup, or could include a solid, like a sugar candy or gelatin shot, which may be consumed separate from host vessel 28 and the resultant structure when a seal 314 is removed from capsule 324. Additional structures are contemplated to guide and stop rotation in various pre-determined positions.

With regard to the processes described herein, it should be understood that, although the steps of such processes, have been described as occurring in a certain sequence, such processes could be practiced with the described steps performed in an order other than the exemplary order. It further should be understood that certain steps could be performed simultaneously, that other steps could be added, or that certain steps described herein could be omitted. In other words, the descriptions of processes herein are provided for the purpose of illustrating certain embodiments and should in no way be construed so as to limit the claimed invention.

Accordingly, it is to be understood that the above description is intended to be illustrative and not restrictive. Many embodiments and applications other than the examples provided would be apparent upon reading the above description. The scope of the invention should be determined with reference to the appended claims along with the full scope of equivalents to which such claims are entitled. It is anticipated and intended that future developments will occur, and that the disclosed systems and processes will be incorporated into such future embodiments. The invention is capable of modification and variation.

All terms used in the claims are intended to be given their broadest reasonable constructions and their ordinary meanings as understood by those knowledgeable in the technologies described herein unless an explicit indication to the contrary is made herein. Use of the singular articles such as "a," "the," "said," recite one or more of the indicated elements unless a claim recites an explicit limitation to the contrary.

What is claimed as new and desired to be protected by Letters Patent of the United States is:

1. A dispensing device, comprising:

a) a rotatable capsule having a dispensing portal including an aperture;

b) a body supporting the rotatable capsule, the body being connected with a cover and the body including a pathway through which the dispensing portal is movable to rotate the rotatable capsule between (i) a closed position wherein the dispensing portal faces a direction toward the cover, and (ii) an open position wherein the dispensing portal faces a direction different from the closed position, such position being configured to permit release of contents in the rotatable capsule through the aperture;

c) wherein the rotatable capsule and at least a section of body in mechanical communication with the rotatable capsule are sufficiently flexible to permit compression by hand to release contents in the rotatable capsule; and d) wherein at least one of the cover or body are mechanically connectable to a host vessel.

2. The dispensing device of claim 1, wherein the rotatable capsule has a shape of a sphere or spheroid.

3. The dispensing device of claim 1, wherein at least a portion of the cover is sufficiently flexible to permit compression by hand for the portion of the cover to apply sufficient force on the section of body in mechanical communication with the rotatable capsule to release contents in the rotatable capsule.

4. The dispensing device of claim 1, wherein the rotatable capsule further includes a rotation assistance mechanism including at least one of texturing on a portion of the rotatable capsule, a tab on the rotatable capsule, markings on the rotatable capsule, body or cover to indicate direction of rotation for opening or closing the dispensing device.

5. The dispensing device of claim 1, wherein the rotatable capsule includes an anti-permeation barrier.

6. The dispensing device of claim 1, wherein the cover is integrally formed with the body.

7. The dispensing device of claim 1, wherein the cover is removably attached to the body.

8. The dispensing device of claim 1, wherein one of the body or the cover includes an insertion-and-removal assistance mechanism.

9. The dispensing device of claim 1, wherein the cover includes a removable top portion that when removed forms an invertible structure including a topless cover and the rotatable capsule, the invertible structure configured for dispensing contents of the rotatable capsule through the dispensing portal and through the topless cover.

10. The dispensing device of claim 1, wherein the cover is rotatable to connect or disconnect with the host vessel in two opposite directions, both opposite directions being orthogonal to a direction in which the rotatable capsule is rotatable to move between the open position and the closed position.

11. The dispensing device of claim 1, further including an illumination device on one or more of the cover or the body.

12. The dispensing device of claim 1, wherein at least one of the cover or the body is attached to the host vessel.

13. A dispensing device, comprising:

a) rotatable capsule having a dispensing portal including an aperture;

b) a body supporting the rotatable capsule, the body being connected with a cover and the body including a pathway through which the dispensing portal is movable to rotate the rotatable capsule between (i) a closed position wherein the dispensing portal faces a direction toward the cover, and (ii) an open position wherein the dispensing portal faces a direction different from the closed position, such position being configured to permit release of contents in the rotatable capsule through the aperture;

c) wherein at least one of the cover or body are mechanically connectable to a host vessel; and d) wherein the dispensing portal comprises a protuberance on an outer surface of the rotatable capsule, the protuberance having a channel alignable with the aperture on one end that extends to an exterior surface of the protuberance on an opposite end.

14. The dispensing device of claim 13 wherein the rotatable capsule further includes a snorkel having an air intake end at the protuberance and an air exhaust end inside the rotatable capsule.

15. The dispensing device of claim 14 wherein the snorkel further includes a check valve at or near the air exhaust end.

* * * * *